10/15/85 XR 4,547,697

United States Patent [19]

Burdick et al.

[11] Patent Number: 4,547,697

[45] Date of Patent: Oct. 15, 1985

[54] CRT SHUNT RETAINING MEANS

[75] Inventors: Glen A. Burdick, Harrison, Me.; Floyd K. Collins, Seneca Falls; Alan T. Kuryla, Geneva, both of N.Y.

[73] Assignee: North American Philips Consumer Electronics Corp., New York, N.Y.

[21] Appl. No.: 516,022

[22] Filed: Jul. 22, 1983

[51] Int. Cl.[4] ..... H01J 29/76; H01J 29/51

[52] U.S. Cl. ..... 313/412; 313/413; 313/414; 313/426

[58] Field of Search ..... 313/412, 413, 414, 426

[56] References Cited

U.S. PATENT DOCUMENTS 3,772,554 11/1973 Hughes ..... 313/412
4,196,370 4/1980 Hughes ..... 313/413
4,225,804 9/1980 Bekaert et al. ..... 313/412
4,370,593 1/1983 Sweigart et al. ..... 313/414

FOREIGN PATENT DOCUMENTS 56-82551 7/1981 Japan ..... 313/412

*Primary Examiner*—William Smith
*Attorney, Agent, or Firm*—John C. Fox

[57] ABSTRACT

Planar apertured shunts surrounding the outer apertures of the final convergence electrode of a color cathode ray tube electron gun, used for correction of the beam-deflecting magnetic fields associated with the outer electron beams, are captivated by apertured retaining means, having shunt-accommodating pockets surrounded by a peripheral seating rim affixed to the bottom of the convergence electrode.

3 Claims, 11 Drawing Figures

CRT SHUNT RETAINING MEANS

BACKGROUND OF THE INVENTION

This invention pertains to a color cathode ray tube (CCRT) having a plural-beam in-line electron gun assembly, and more particularly to means for retaining magnetic shunts in the terminal convergence electrode of said gun assembly.

Cathode ray tubes employed in color television and associated display applications commonly utilize an in-line assembly of three electron guns positioned in the neck region of the CRT envelope, from which three separate electron beams emanate in a subtantially common plane. During tube operation, the respective beams are directed along related paths to converge at the plane of a multi-opening color selection electrode or "aperture mask" positioned adjacent to a patterned cathodoluminescent screen. Upon passing through the respective openings or apertures, the converged beams diverge lightly to impinge upon discrete color-emitting areas of the patterned screen.

An associated deflection yoke surrounding the neck in the region of the gun creates magnetic fields which cause the individual beams to scan the screen, thereby producing three different color-raster patterns which conjunctively comprise the screen display.

Technical advancement in in-line CRT's has resulted in simplified dynamic convergence circuitry and a self-converging yoke which automatically corrects for "pin cushion" distortion of the rasters. The resulting raster patterns nevertheless sometimes evidence coma error. That is, their sizes may differ slightly due to the interaction of the yoke fields on the respective electron beams.

To effect coma correction, the prior art has taught the usage of magnetic "shunts" positioned within the gun assembly relative to the plane of deflection to influence or shunt the magnetic fields for particular in-line beams. One successful method of achieving coma correction is to surround the two side-related in-line beams with two disc-like apertured magnetic shielding members at the terminal element or convergence cup of the electron gun assembly. Being so oriented, the shielding members weaken the effect of the yoke-induced horizontal and vertical magnetic deflection fields on the side electron beams.

The shielding members are conventionally affixed to the bottom surface of the convergence electrode by a plurality of spot welds, a procedure which has sometimes produced deleterious effects. Specifically, it has been found that the pressure and heat of welding can sometimes produce localized distortions of the crystal structure of the magnetic shunt material, thereby altering its shunting capabilities. Also, any bending or working of the shunt during affixation could also change its desired shunting characteristics.

SUMMARY OF THE INVENTION

In accordance with the invention, magnetic shunt means employed in the terminally positioned convergence cup of the in-line electron gun assemblies of color CRT's, which are associated with at least one of the side-related in-line apertures in the convergence cup, are secured in their desired position by captivation means, and thus are not subjected to deforming welding pressures or adverse heat. Captivation is achieved by providing each shunt with a separate shunt retaining element of a substantially planar configuration and having an aperture therein of a size to provide superjacent framing encompassment for each shunt. This apertured encompassing member is affixed to the bottom of the convergence cup at areas beyond the periphery of the captivated shunt. Thus, no deleterious affixation pressure, heat, bending, working or other stresses affect the shunt per se. To adequately encompass the shunt, each retaining member has a peripheral seating rim and a shallow apertured shunt-accommodating pocket formed inwardly from the seating rim. Each pocket has a wall portion which defines the height of the pocket, which is adequate to accommodate the material thickness of the shunt retained therein, and a planar top portion.

Each of these shunt-retaining pockets is dimensioned and positioned to effect alignment of the shunt with its associated aperture. In one embodiment of the invention, a plurality of shunt-aligning indentations are formed in the encompassing wall portion of the pocket, such indentations preferably being oriented to make edge contact with the periphery of the shunt. In another embodiment, a plurality of tongue-like parts or tabs are formed as recessed cut-outs within the pocket portion of the retaining means. Each of the tabs has a basal portion, located at the jointure of the wall of the pocket and the surrounding peripheral rim, and a forward portion which is bent to the plane of the shunt, the terminal edge of which is oriented to substantially abut the perimetrical edge of the shunt thereby effecting the desired alignment and position. If desired, the shunt retaining means can be fabricated as a single unit with openings formed therein for each of the associated shunts.

Affixation of the shunt retaining means is accomplished, for example, by one or more welds joining the seating rim with the bottom of the convergence cup. Another affixation means is one or more tabs formed in the retaining means and positioned to project through mated perforations in the bottom of the electrode, whereupon the tabs are bent to come in contact with the bottom surface of the convergence cup.

DESCRIPTION OF THE PREFERRED EMBODIMENTS

For a fuller understanding of the present invention, together with other and further objects, advantages and capabilities thereof, reference is made to the following disclosure and appended claims in conjunction with the accompanying drawings.

Figure 1:
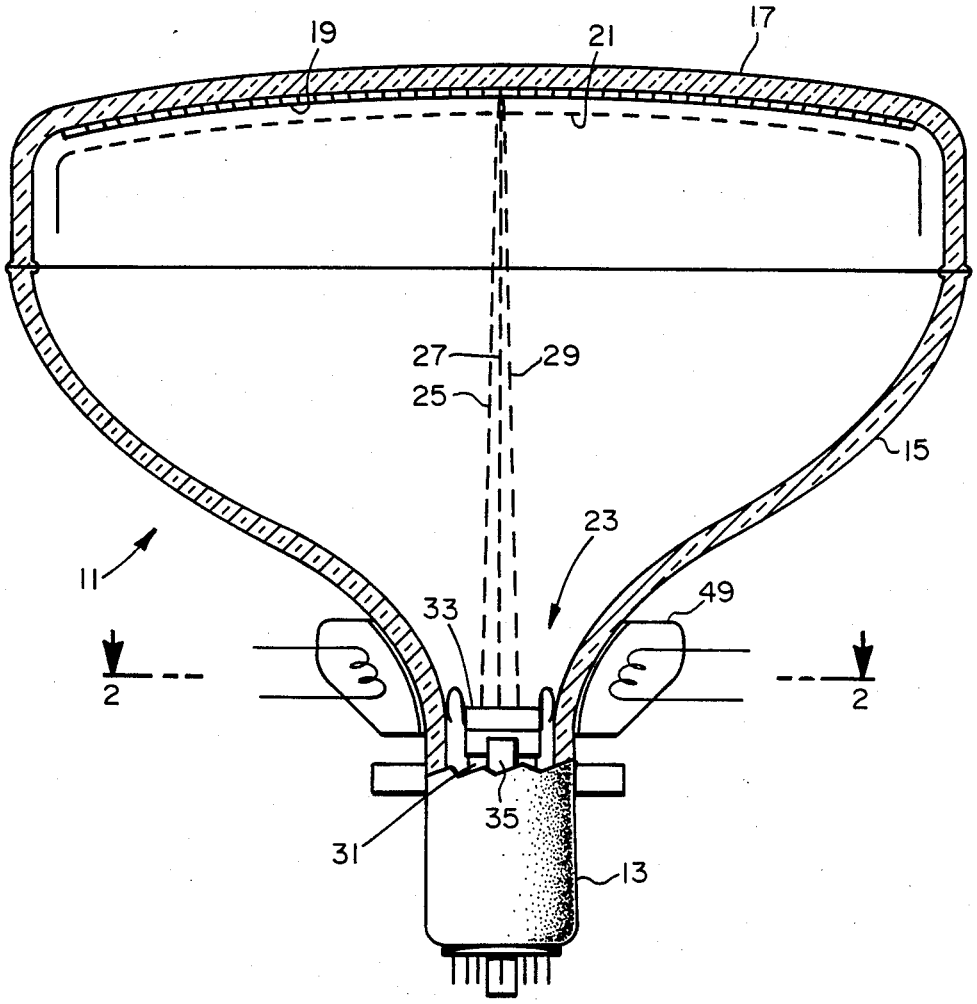
FIG. 1 is a sectioned elevation view of an in-line color cathode ray tube wherein the invention is utilized.

With reference to the drawings, there is shown in FIG. 1, a color cathode ray tube (CCRT) 11 of the type employing a plural beam in-line electron gun assembly. The envelope enclosure is comprised of an integration of neck 13, funnel 15, and face panel 17 portions. Suitably disposed on the interior surface of the face panel is a patterned cathodoluminescent screen 19 formed as a repetitive array of color-emitting phosphor components in keeping with the state of the art. A multi-opening structure 21, such as a grid or aperture mask, is positioned within the face panel in spatial relationship to the patterned screen.

Encompassed within the envelope neck portion 13 is a unitized plural beam in-line electron gun assembly 23, wherein three separate electron beams 25, 27, and 29 are formed in a substantially common plane and projected toward the patterned screen 19. These are respectively denoted as a center beam 27 flanked by side beams 25 and 29. The electron gun assembly 23 is comprised of a plurality of sequentially positioned electrode members of which only the final anode 31 and the integrally attached terminal triple apertured convergence cup 33 are shown in the Figures. The several electrode members of the gun assembly are positionally aligned and supported by at least two longitudinal insulative members 35 and 37.

The bottom 34 of the convergence cup 33 has three in-line apertures 39, 41, and 43 therein to provide for the passage of electron beams 25, 27, and 29 therethrough. In certain cup-like convergence electrode structures, such as that considered herein, the bottom is formed to have two opposed shelf-like indents 45 and 47 flanking the in-line apertures, to accommodate the forward portions of the insulative supports 35 and 37. Accordingly, in such embodiments the apertures 39, 41, and 43 are located in an elongated area of the bottom of the cup.

In operation of the CCRT, the in line beams leaving the electron gun assembly are positionally controlled by the magnetic fields generated by the coils of the magnetic deflection yoke 49, positioned externally upon the tube envelope at substantially the transitional region between the neck 13 and the funnel 15 portions thereof. The magnetic fields produced by the vertical and horizontal deflection windings of the yoke, in conjunction with associated circuitry, cause the three beams to move or scan, in a converged manner, both horizontally and vertically over the screen to produce three substantially rectangular registered raster patterns on the screen 19. To obtain raster patterns of a common size (i.e., to effect coma correction), it has been a remedial practice in the art to employ magnetic shunt means to modify the magnetic fields in the regions of the side-related apertures 39 and 43 in the forwardly positioned convergence cup. This positioning has proven to be effective for coma correction since the rear portions of the yoke fields extend into the forward region of the gun assembly. Typical shunt means are washer-shaped elements formed of a stable magnetic material such as a nickel-iron alloy composition.

Figure 2:
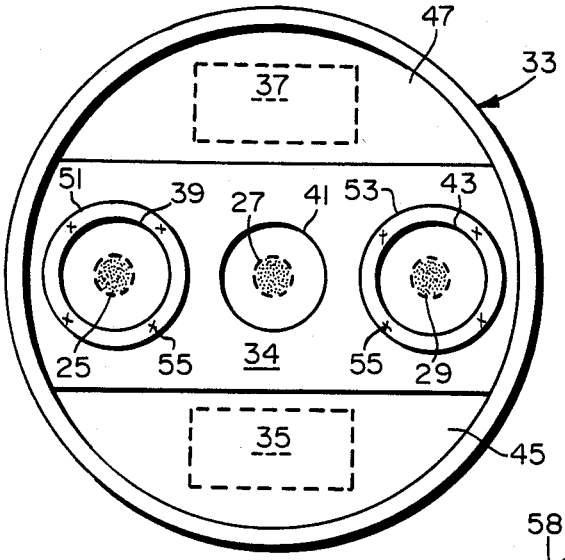
FIG. 2 PRIOR ART
FIG. 2 is a view looking into the terminal convergence cup of the prior art in-line electron gun assembly taken along the line 2—2 of FIG. 1.

As shown in FIG. 2, two similar substantially planar washerlike magnetic shunts 51 and 53 are associated with the respective side-related convergence cup apertures 39 and 43. Each shunt has an aperture which at least equals that of the respective electrode aperture. It has been conventional practice to affix these shunts to the bottom of the electrode by the application of several spaced-apart welds 55.

Since it has been found that the pressure and heat associated with the application of such weld alters the metallic crystal structure of the shunt material, it is the purpose of this invention to provide means for retaining the shunt in accurate and fixed alignment with its associated aperture without deleteriously affecting the magnetic properties thereof.

Figure 3:
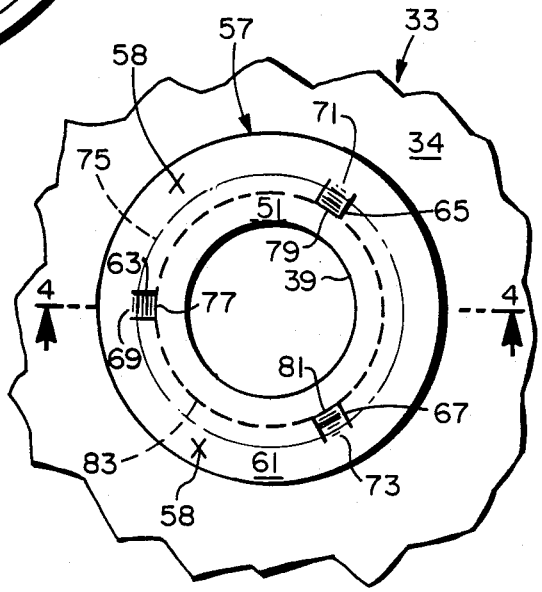
FIG. 3 is an enlarged planar view of one of the side apertures in the convergence cup showing one embodiment of a magnetic shunt captivated by the shunt retaining means of the invention.
Figure 4:
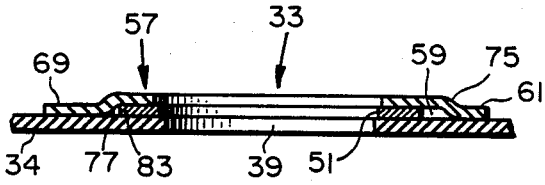
FIG. 4 is a sectioned elevation view of FIG. 3, taken along the line 4—4 thereof.

With reference to FIGS. 3 and 4, one embodiment of the invention shows shunt retaining means 57, in conjunction with shunt 51, associated with convergence cup aperture 39. The aligned apertures of the cup, the shunt and the shunt retaining means may or may not be of substantially the same size. The shunt retaining means 57 is formed of a non-magnetic material, such as 305 stainless steel, and is a substantially planar apertured member oriented in a contiguous position upon the shunt in a manner to captivate the shunt. Being so positioned, the shunt retaining means 57 is suitably affixed to the bottom 34 of the convergence cup 33, e.g., by a plurality of welds 58 located beyond the periphery of captivated shunt means 51.

Figure 11:
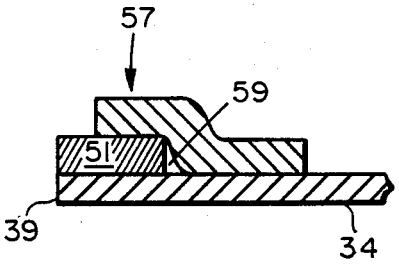
FIG. 11 is a sectioned elevation view illustrating a further embodiment of the invention.

In greater detail, the apertured shunt retaining means 57 is fabricated to have a shallow shunt-accommodating pocket 59 surrounded by a peripheral seating rim 61. The retaining means also has means for effecting alignment of the related apertures in the retaining means, the shunt, and in the convergence cup. This apertural alignment can be achieved in one manner by having pocket 59 closely dimensioned to the diameter of the shunt 51, as shown in FIG. 11. In another embodiment, alignment of the apertures is achieved by a plurality of, e.g., three, spaced-apart formations or indentations in the wall portion of the pocket, such indentations being oriented to make at least partial contact with the peripheral edge of the enclosed shunt means.

The aperture aligning formations are shown in FIGS. 3 and 4 in the form of three equally spaced indents 63, 65 and 67 within the pocket portion of the shunt retaining means, with the respective basal portions of the indents 69, 71, and 73 being substantially situated at the transition zone of the pocket wall 75 and the surrounding peripheral seating rim 61. The forward terminal edges 77, 79, and 81 are bent into the pocket area to abut the perimetrical edge 83 of the shunt, thereby assuring the desired apertural alignment.

Figure 5:
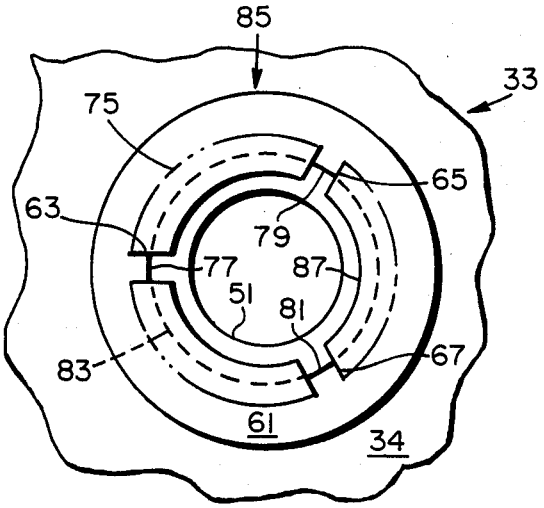
FIG. 5 is an enlarged planar view of another embodiment of the captivated shunt assembly of the invention.
Figure 6:
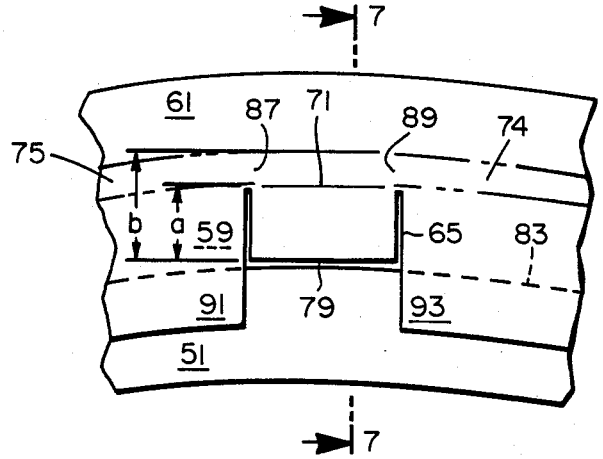
FIG. 6 is an enlarged illustration of a specific tabbed portion of FIG. 5.
Figure 7:
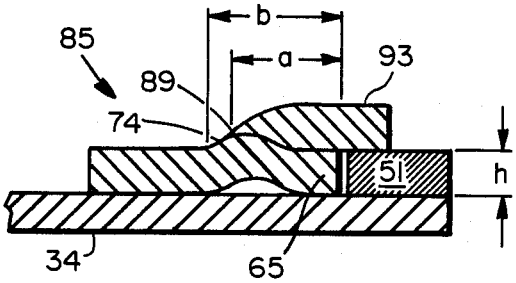
FIG. 7 is a sectioned elevation view of FIG. 6 taken along the line 7—7 thereof.

FIGS. 5, 6, and 7 illustrate another embodiment of the invention, wherein the aperture 87 of the shunt retaining means 85 is enlarged. The height of the shunt encompassing pocket is of a value "h" to adequately accommodate the thickness of shunt 51. In this embodiment, shunt 51 is held in place by tabs 63, 65 and 67 cut from the wall portion of retaining means 85 and bent to abut the perimetrical edge of shunt 51. Referring to FIGS. 6 and 7, wherein the length of tab 65 from its terminal edge 79 to its basal portion 71 is denoted by the dimension "a", while the distance between the forward or terminal edge 79 of the tab and the external transition zone of the wall 74 is of a greater dimension "b". Therefore, upon bending tab 65 to the plane of the shunt 51, as shown in FIG. 7, a downward force is exerted in the adjacent wall regions 87 and 89, whereupon the forward areas 91 and 93 are forced downward to exert a beneficial clamping pressure against shunt 51 without causing any deformation thereof.

Figure 8:
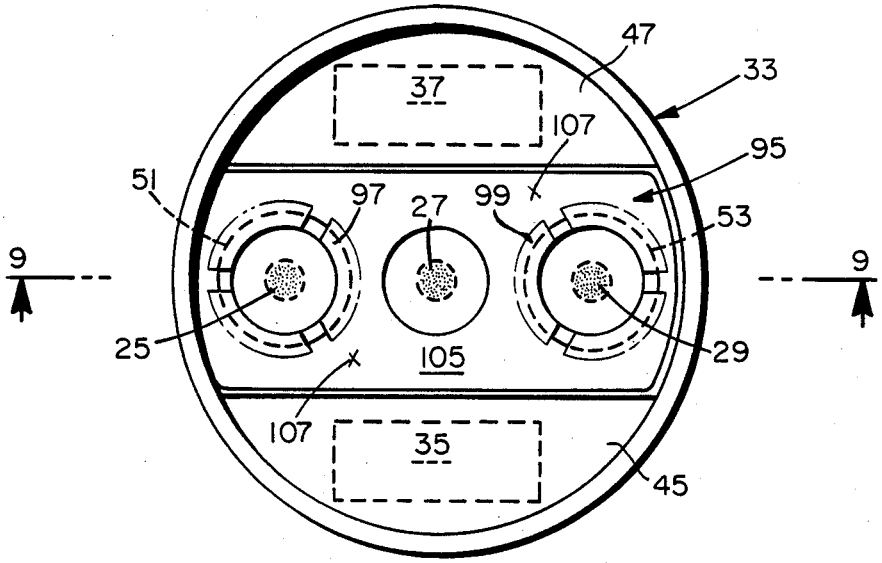
FIG. 8 is a view looking into the terminal convergence cup of the in-line electron gun assembly, taken along the line 2—2 of FIG. 1, illustrating an embodiment of the invention.
Figure 9:
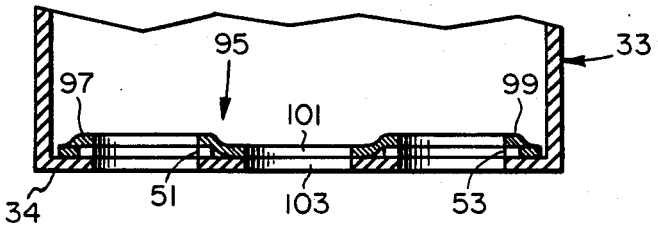
FIG. 9 is a sectioned elevation of FIG. 8 taken along the line 9—9 thereof.
Figure 10:
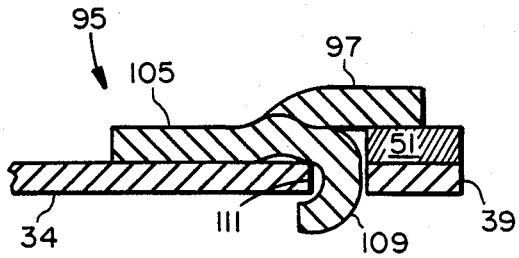
FIG. 10 is a sectioned elevation view illustrating one means of affixation of the shunt captivation means.

The invention also includes a multiple-apertured embodiment of a substantially planar shunt retaining unit 95, as shown in FIGS. 8 and 9. This integrated unit is dimensioned to fit into the apertured recessed region of the convergence cup 33 between the bottom indents 45 and 47 thereof. Two shunt-accommodating pockets 97 and 99 are formed in the unit for the associated side-aperture-related shunt means 51 and 53. A center aperture 101 is formed to accommodate the center aperture 103 in the convergence cup 33. The seating portion 105 of the multiple-apertured unit 95 can be affixed to the bottom of the convergence cup by means such as a plurality of welds 107, two of which are indicated, or tongues, such as 109 shown in FIG. 10, or by other means. Such tongues can be formed on any of the embodiments at suitable positions to project through mated perforations 111 in the bottom 34 of the cup 33, and bent against the bottom 34 of the cup.

We claim:

1. An improvement in a color cathode ray tube employing an assembly of three in-line electron guns emitting a center and two side electron beams in a common plane from three in-line apertures in a terminally positioned convergence cup, said cup having an apertured magnetic shunt associated with at least one of said side apertures, said shunt is captivated by apertured retaining means, said means having a shunt-accommodating pocket defined by a substantial planar apertured top portion and a sidewall portion, the pocket surrounded by a peripheral seating rim affixed to the bottom of the convergence cup in position to align the apertures of the cup, shunt and retaining means, the sidewall portion having a plurality of spaced-apart indentations which abut the peripheral edge of the shunt, to thereby effect apertural alignment of the shunt and the convergence cup.

2. An improvement in a color cathode ray tube employing an assembly of three in-line electron guns emitting a center and two side electron beams in a common plane from three in-line apertures in a terminally positioned convergence cup, said cup having an apertured magnetic shunt associated with at least one of said side apertures, said shunt is captivated by apertured retaining means, said means having a shunt-accommodating pocket defined by a substantial planar apertured top portion and a sidewall portion, the pocket surrounded by a peripheral seating rim affixed to the bottom of the convergence cup in position to align the apertures of the cup, shunt and retaining means, a plurality of spaced-apart tabs integrally formed from the pocket portion of said shunt retaining means, and having a basal portion near the peripheral seating rim, and a forward portion abutting the perpherial edge of said shunt, to thereby effect apertural alignment of the shunt and the convergence cup.

3. An improvement in a color cathode ray tube employing an assembly of three in-line electron guns emitting a center and two side electron beams in a common plane from three in-line apertures in a terminally positioned convergence cup, said cup having an apertured magnetic shunt associated with at least one of said side apertures, said shunt is captivated by apertured retaining means, said means having a shunt-accommodating pocket defined by a substantial planar apertured top portion and a sidewall portion, the pocket surrounded by a peripheral seating rim affixed to the bottom of the convergence cup in position to align the apertures of the cup, shunt and retaining means, said shunt retaining means affixed to said convergence cup by a plurality of tongues projecting through mated perforations in said cup and bent against the bottom of said cup.

* * * * *